US010263363B2

(12) United States Patent
Kida

(10) Patent No.: US 10,263,363 B2
(45) Date of Patent: Apr. 16, 2019

(54) CONNECTOR

(71) Applicant: YAZAKI CORPORATION, Tokyo (JP)

(72) Inventor: Kousuke Kida, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 15/122,049

(22) PCT Filed: Mar. 20, 2015

(86) PCT No.: PCT/JP2015/058632
§ 371 (c)(1),
(2) Date: Aug. 26, 2016

(87) PCT Pub. No.: WO2015/151889
PCT Pub. Date: Oct. 8, 2015

(65) Prior Publication Data

US 2017/0018874 A1 Jan. 19, 2017

(30) Foreign Application Priority Data

Mar. 31, 2014 (JP) ..... 2014-072817

(51) Int. Cl.
*H01R 13/627* (2006.01)
*H01R 13/436* (2006.01)
(Continued)

(52) U.S. Cl.
CPC ..... *H01R 13/6272* (2013.01); *H01R 13/4362* (2013.01); *H01R 13/5216* (2013.01); *H01R 13/639* (2013.01)

(58) Field of Classification Search
CPC ..... H01R 13/6272
(Continued)

(56) References Cited

U.S. PATENT DOCUMENTS 4,801,275 A * 1/1989 Ikeda ..... H01R 13/6272 439/350
4,986,766 A * 1/1991 Leonard ..... H01R 13/6272 439/352
(Continued)

FOREIGN PATENT DOCUMENTS

CN 201904492 U 7/2011
CN 102570133 A 7/2012
(Continued)

OTHER PUBLICATIONS

International Preliminary Report on Patentability and English language Written Opinion of he International Search Report for PCT/JP2015/058632 dated Oct. 4, 2016.
(Continued)

*Primary Examiner* — Neil Abrams
(74) *Attorney, Agent, or Firm* — Kenealy Vaidya LLP

(57) ABSTRACT

In a connector (4) including: a first connector housing (5) including a hood portion (52) having a substantially cylinder shape to be fitted to an outer circumference of a cylindrical portion (82) of a second connector housing (8), and a lock arm (53) formed integrally with a terminal storing portion (51) such that a free end side of the lock arm (53) is deflected and deformed in a direction perpendicular to a surface of the cylindrical portion (82); and the second connector housing (8) including the cylindrical portion (82), and a lock protrusion (83) which is provided to protrude from an outer surface of the cylindrical portion (82) and which engages the lock arm (53) when a fitting length between the cylindrical portion (82) and the hood portion (52) reaches a predetermined value, the first connector housing (5) is formed of a hydrolysis-resistant material.

4 Claims, 8 Drawing Sheets

(51) Int. Cl.
*H01R 13/52* (2006.01)
*H01R 13/639* (2006.01)

(58) Field of Classification Search
USPC ..... 439/357, 358
See application file for complete search history.

(56) References Cited

U.S. PATENT DOCUMENTS 5,624,272 A * 4/1997 Ohsumi ..... H01R 13/6272 439/353
6,146,183 A * 11/2000 Jinno ..... H01R 13/6272 439/358
6,169,159 B1 1/2001 Kawamoto et al.
6,179,639 B1 * 1/2001 Kuwahara ..... H01R 13/6277 439/282
6,669,398 B2 * 12/2003 Wada ..... C08J 9/0004 403/322.4
7,056,142 B2 * 6/2006 Ueda ..... H01R 13/6272 439/328
7,101,213 B2 * 9/2006 Toyoda ..... H01R 13/6272 439/358
7,156,684 B2 * 1/2007 Ichida ..... H01R 13/633 439/352
7,267,570 B2 * 9/2007 Fry, Jr. ..... H01R 13/6272 439/357
8,016,606 B1 * 9/2011 Kwan ..... H01R 13/641 439/352
8,758,038 B2 * 6/2014 Kubo ..... H01R 13/6272 439/358
8,882,528 B2 * 11/2014 Sasho ..... H01R 13/6335 439/358
9,070,999 B2 * 6/2015 Endo ..... H01R 13/506
9,203,190 B2 * 12/2015 Hamai ..... H01R 13/6272
9,583,876 B2 * 2/2017 Sekino ..... H01R 13/62933
2001/0035652 A1 11/2001 Wada et al.
2012/0156917 A1 6/2012 Sasho et al.
2013/0084733 A1 4/2013 Kubo et al.
2014/0179146 A1 6/2014 Hamai et al.
2017/0018874 A1 * 1/2017 Kida ..... H01R 13/4362

FOREIGN PATENT DOCUMENTS

CN 103782455 A 5/2014
JP 11-43532 A 2/1999
JP 2001-250636 A 9/2001
JP 2007-291277 A 11/2007
JP 2012-129076 A 7/2012
JP 2013-77440 A 4/2013
WO 2013/035886 A1 3/2013

OTHER PUBLICATIONS

Japanese Office Action for the related Japanese Patent Application No. 2014-072817 dated Dec. 19, 2017.
Japanese Office Action for the related Japanese Patent Application No. 2014-072817 dated Mar. 6, 2018.
Chinese Office Action for the related Chinese Patent Application No. 201580011018.4 dated Nov. 24, 2017.
Japanese Decision to Decline the Amendment for the related Japanese Patent Application No. 2014-072817 dated Aug. 28, 2018.
Japanese Decision of Refusal for the related Japanese Patent Application No. 2014-072817 dated Aug. 28, 2018.
Chinese Office Action for the related Chinese Patent Application No. 201580011018.4 dated Jun. 27, 2018.
International Search Report and Written Opinion of the International Search Report for PCT/JP2015/058632 dated Jun. 9, 2015.
Reconsideration by Examiner before Appeal for the related Japanese Patent Application No. 2014-072817 dated Dec. 5, 2018.
Chinese Office Action for the related Chinese Patent Application No. 201580011018.4 dated Dec. 24, 2018.

* cited by examiner

CONNECTOR

TECHNICAL FIELD

The present invention relates to a connector.

BACKGROUND ART

FIGS. 6 to 9 show a connector disclosed in the following Patent Document 1.

As shown in FIG. 6, the connector 100 includes a first connector housing 110 and a second connector housing 120.

The first connector housing 110 includes a hood portion 111 and a lock arm 112. The hood portion 111 which is substantially shaped like a cylinder is fitted to an outer circumference of a cylindrical portion 121 of the second connector housing 120 serving as a connection counterpart. The lock arm 112 is formed integrally with the first connector housing 110.

The lock arm 112 includes an erect portion 113 and an arm body 114. The erect portion 113 rises from a position close to a base end (right end in FIG. 6) of the first connector housing 110. The arm body 114 extends toward a front end side of the hood portion 111 from a distal end of the erect portion 113. The arm body 114 is formed into a single-end supported beam shape in which a distal end 114*a* of the arm body 114 serves as a free end. When the first connector housing 110 and the second connector housing 120 are fitted to each other as shown in FIG. 8, the distal end 114*a* side of the arm body 114 is deflected and deformed in a direction (direction of an arrow X1 in FIG. 6 or direction of an arrow R1 in FIG. 8) substantially perpendicular to the surface of the cylindrical portion 121 which will be described later so that the distal end 114*a* side of the arm body 114 can allow a lock protrusion 122 of the second connector housing 120 to move.

In addition, the arm body 114 includes a cavity 114*b* engaged with the lock protrusion 122 of the second connector housing 120 which will be described later, in a position close to the free end.

A release arm 115 is formed integrally with the lock arm 112. The release arm 115 includes arm portions 115*a* and an operating portion 115*b*. The arm portions 115*a* extend toward the base end side of the first connector housing 110 from both end portions of the distal end 114*a* of the lock arm 112. Distal ends of the pair of arm portions 115*a* are connected to each other through the operating portion 115*b*.

When the operating portion 115*b* of the release arm 115 is pushed down in a direction of an arrow Z1 as shown in FIG. 9, the arm portions 115*a* swing accordingly so that the distal end 114*a* of the lock arm 112 connected to base ends of the arm portions 115*a* can be displaced in a direction of an arrow R1. Accordingly, when the operating portion 115*b* of the release arm 115 is pushed down, engagement between the lock arm 112 and the lock protrusion 122 is released so that the connector housings can be disconnected from each other.

The second connector housing 120 includes the cylindrical portion 121 and the lock protrusion 122. The aforementioned hood portion 111 is fitted to the outer circumference of the cylindrical portion 121. The lock protrusion 122 is provided to protrude from an outer surface of the cylindrical portion 121. When a fitting length between the cylindrical portion 121 and the hood portion 111 reaches a predetermined value as shown in FIG. 9, the lock protrusion 122 is engaged with the lock arm 112 to thereby lock the fitting state between the first connector housing 110 and the second connector housing 120.

PRIOR ART DOCUMENT(S)

Patent Document(s)

Patent Document 1: JP-A-2001-250636

SUMMARY OF THE INVENTION

Problem to be Solved by the Invention

The first connector housing 110 or the second connector housing 120 constituting the connector 100 according to Patent Document 1 is normally formed integrally by injection molding of a synthetic resin such as PBT (polybutylene terephthalate resin).

However, when the first connector housing 110 or the second connector housing 120 formed of the PBT is used for a long term, for example, in a high temperature high humid environment such as an engine room of a vehicle, there is a fear that mechanical strength may be lowered by degradation of the PBT due to hydrolysis.

Therefore, when connection or disconnection between the connector housings is repeated, there is a fear that the lock arm undergoing a bending load when the connector housings are connected to or disconnected from each other may be damaged due to the degradation of the material.

Therefore, in order to solve the foregoing problem, an object of the invention is to provide a connector in which a lock arm undergoing a bending load when connector housings are connected to or disconnected from each other can be suppressed from being damaged due to degradation of the material even in long-term use under a high temperature high humid environment so that the lock arm can be used satisfactorily for a long term.

Solutions to the Problem

The above-described object of the present invention is achieved by the configurations described below.

(1) A connector including:

a first connector housing including: a hood portion having a substantially cylinder shape to be fitted to an outer circumference of a cylindrical portion of a connection counterpart connector housing; a terminal storing portion which stores a terminal metal fitting; and a lock arm formed integrally with the terminal storing portion such that a free end side of the lock arm is deflected and deformed in a direction perpendicular to a surface of the cylindrical portion; and a second connector housing including: the cylindrical portion; and a lock protrusion which is provided to protrude from an outer surface of the cylindrical portion and which engages the lock arm when a fitting length between the cylindrical portion and the terminal storing portion reaches a predetermined value, wherein the first connector housing is formed of a hydrolysis-resistant material.

(2) The connector according to the configuration (1), wherein a base end portion of the lock arm rising from the terminal storing portion is formed into a smooth curved shape with which a bending load is difficult to be concentrated.

(3) The connector according to the configuration (2), wherein the lock arm includes: a plate spring portion having a flat plate shape extending in a fitting direction between the connector housings from a distal end of the base end portion; and a protrusion engagement portion which has an engagement hole with which the lock protrusion is engaged and which is provided in a distal end of the plate spring portion, and wherein the protrusion engagement portion is formed to be thicker than the plate spring portion.

According to the aforementioned configuration (1), even when the first connector housing formed of the hydrolysis-resistant material is used for a long term under a high temperature high humid environment such as an engine room, material properties are hardly degraded. Even when connection/disconnection between the connector housings is repeated, the lock arm undergoing a bending load can be suppressed from being damaged due to the degradation of the material. Accordingly, the lock arm can be used satisfactorily for a long term.

According to the aforementioned configuration (2), the base end portion of the lock arm rising from the terminal storing portion is formed into the smooth curved shape with which the bending load is difficult to be concentrated. Therefore, when the lock arm is deflected and deformed to be engaged with or disengaged from the lock protrusion of the second connector housing, the bending load can be prevented from concentratively acting on a part of the base end portion of the lock arm. Accordingly, durability of the lock arm can be improved.

According to the aforementioned configuration (3), the engagement hole with which the lock protrusion is engaged is formed in the protrusion engagement portion of the lock arm. The formation of the engagement hole is unfavorable for the strength of the protrusion engagement portion. However, since the protrusion engagement portion is formed to be thicker than the plate spring portion, the strength of the protrusion engagement portion can be improved. Accordingly, the strength of the protrusion engagement portion of the lock arm can be prevented from being lower than that of the plate spring portion so that durability of the lock arm can be improved.

Advantages of the Invention

According to the connector according to the invention, the lock arm undergoing a bending load when the connector housings are connected to or disconnected from each other can be suppressed from being damaged due to degradation of the material even in long-term use under a high temperature high humid environment. Accordingly, the lock arm can be used satisfactorily for a long term.

The invention has been described above briefly. When an undermentioned mode (hereinafter referred to as "embodiment") for carrying out the invention is read through with reference to the accompanying drawings, details of the invention can be made further clear.

MODE FOR CARRYING OUT THE INVENTION

A preferable embodiment of a connector according to the invention will be described below in detail with reference to the drawings.

Figure 1:
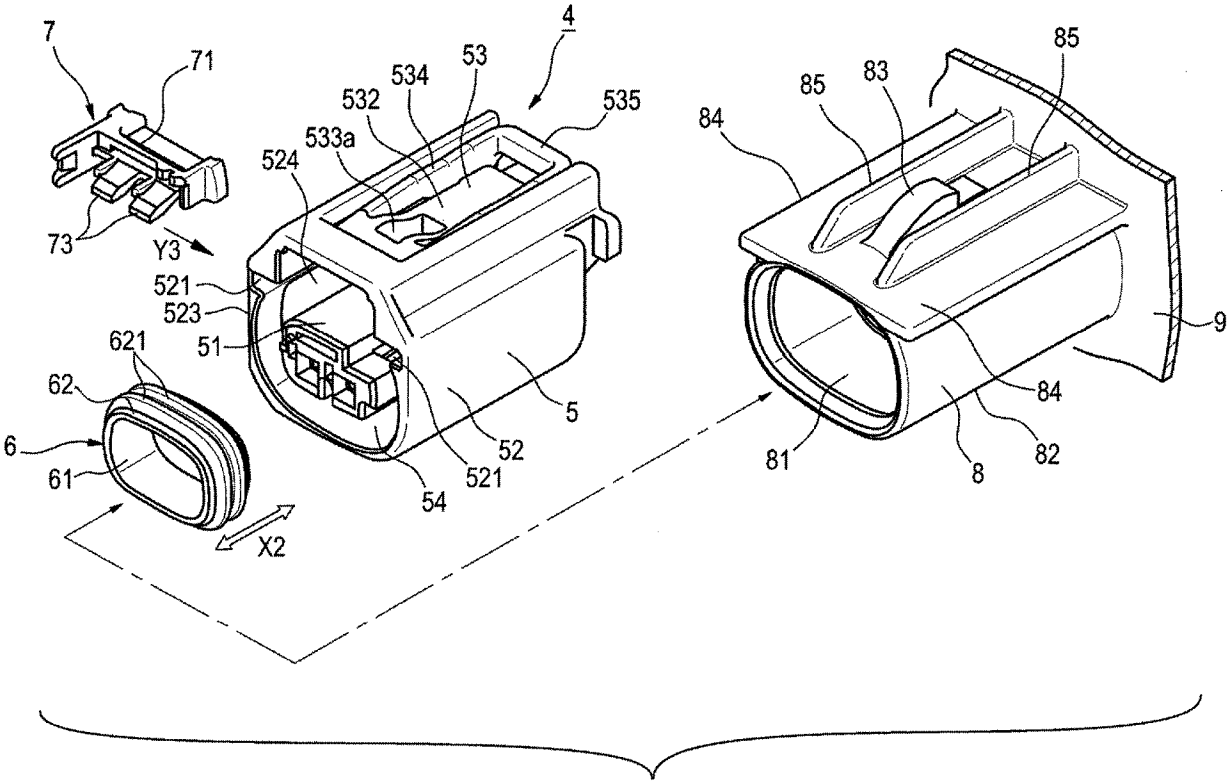
FIG. 1 is an exploded perspective view of an embodiment of a connector according to the invention.

A connector 4 in an embodiment according to the invention is a waterproof connector. As shown in FIG. 1, the connector 4 includes a first connector housing 5, a packing 6, a retainer 7, and a second connector housing 8. The packing 6 shaped like a cylinder is fitted to and mounted on a terminal storing portion 51 of the first connector housing 5 which will be described later. The retainer 7 is inserted into the first connector housing 5 from one side surface of the first connector housing 5. The second connector housing 8 serves as a connection counterpart connector housing relatively to the first connector housing 5.

The first connector housing 5 is integrally formed of a hydrolysis-resistant resin material. The first connector housing 5 includes the terminal storing portion 51, a hood portion 52, and a lock arm 53. The terminal storing portion 51 stores not-shown first terminal metal fittings. The hood portion 52 is formed into a cylindrical structure surrounding the terminal storing portion 51. The lock arm 53 is formed integrally with the terminal storing portion 51.

For example, PBT-GF15 may be used as the hydrolysis-resistant resin material for forming the first connector housing 5. PBT-GF15 is a PBT (polybutylene terephthalate resin) product added with a glass fiber content of 15% to reinforce hydrolysis resistance. Incidentally, in design, permissible strain of the material caused by molding is not higher than 3%. In the embodiment, the permissible strain is designed to be not higher than 2.5% so that there is no portion where stress is concentrated to cause permissible strain higher than 2.5%.

The terminal storing portion 51 is a region which is substantially formed into a columnar shape extending in a fitting direction (direction of an arrow X2 in FIG. 1) to the second connector housing 8.

As shown in FIG. 1, the hood portion 52 defines a gap 54 surrounding the terminal storing portion 51 so that a cylindrical portion 82 of the second connector housing 8 which will be described later can be fitted into the gap 54. The hood portion 52 is fitted to an outer circumference of the cylindrical portion 82 of the second connector housing 8 fitted into the gap 54. As shown in FIG. 1, the hood portion 52 according to the embodiment includes horizontal guide grooves 521 and vertical guide grooves 522. Horizontal guide ribs 84 of the second connector housing 8 which will be described later are fitted into the horizontal guide grooves 521 slidably. Vertical guide ribs 85 of the second connector housing 8 which will be described later are fitted into the vertical guide groove 522 slidably.

When the first connector housing 5 and the second connector housing 8 are operated to be fitted to each other, the horizontal guide ribs 84 and the vertical guide ribs 85 of the second connector housing 8 which will be described later are fitted into the horizontal guide grooves 521 and the vertical guide grooves 522 provided in the hood portion 52. In this manner, a direction of moving the first connector housing 5 and the second connector housing 8 relatively to each other is restricted to prevent one of the connector housings from being inclined. Thus, torsion is prevented from occurring.

In the first connector housing 5 according to the embodiment, a retainer inserting port 524 is formed to pierce one side surface 523 of the hood portion 52, as shown in FIG. 1. The retainer inserting port 524 is an opening for inserting the retainer 7. The retainer inserting port 524 is provided in a position opposed to a retainer inserting portion (not shown) of the terminal storing portion 51. Accordingly, a housing lock arm 71, temporary lock lances 73 and terminal lock portions (not shown) of the retainer 7 inserted into the retainer inserting port 524 can be inserted through the retainer inserting portion.

As shown in FIG. 1, the retainer 7 is inserted in a connector width direction into the first connector housing 5 from the retainer inserting port 524 opened in the one side surface of the first connector housing 5. An arrow Y3 in FIG. 1 designates an insertion direction of the retainer 7.

When the retainer 7 is inserted into the first connector housing 5, the retainer 7 can be positioned in a temporary lock position and a regular lock position. The terminal metal fittings can be inserted into the terminal storing portion 51 in the temporary lock position. The terminal metal fittings inserted into the terminal storing portion 51 are prevented from dropping off in the regular lock position.

Figure 5:
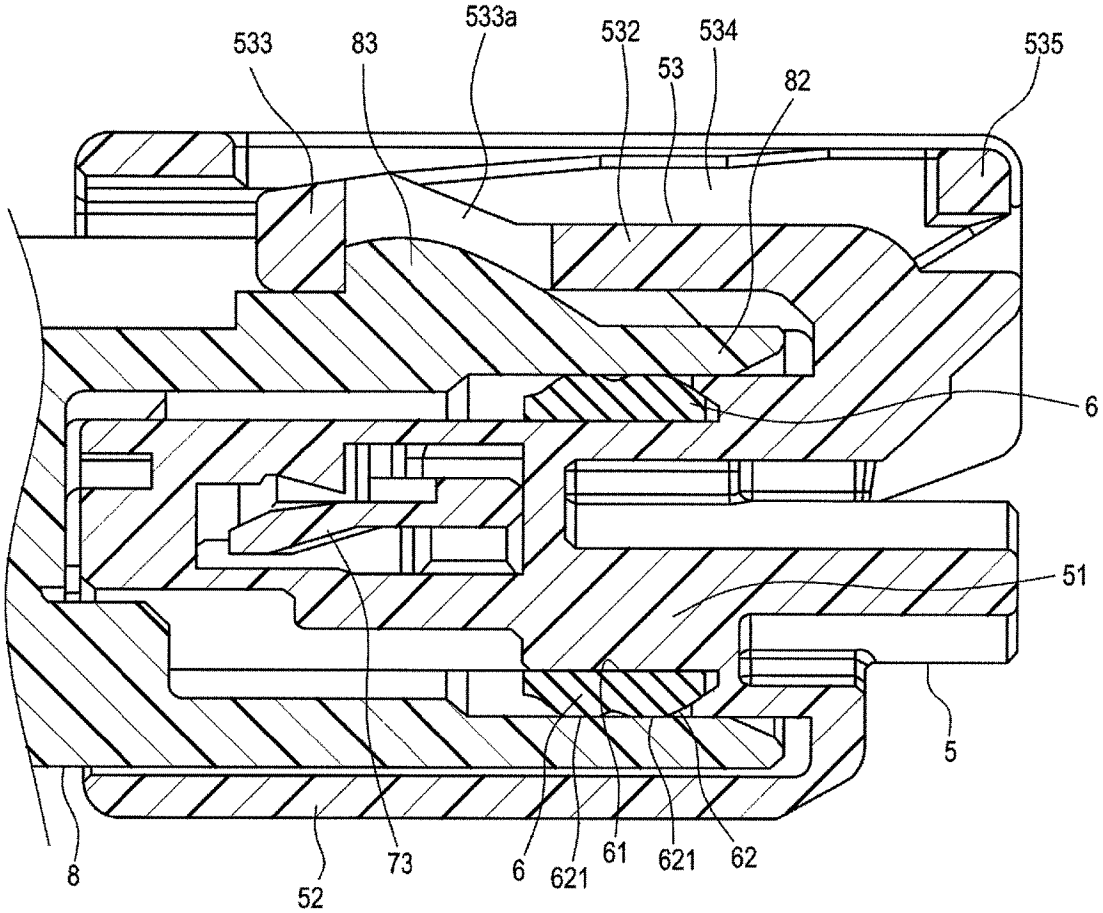
FIG. 5 is a longitudinal sectional view of the connector shown in FIG. 1.
Figure 6:
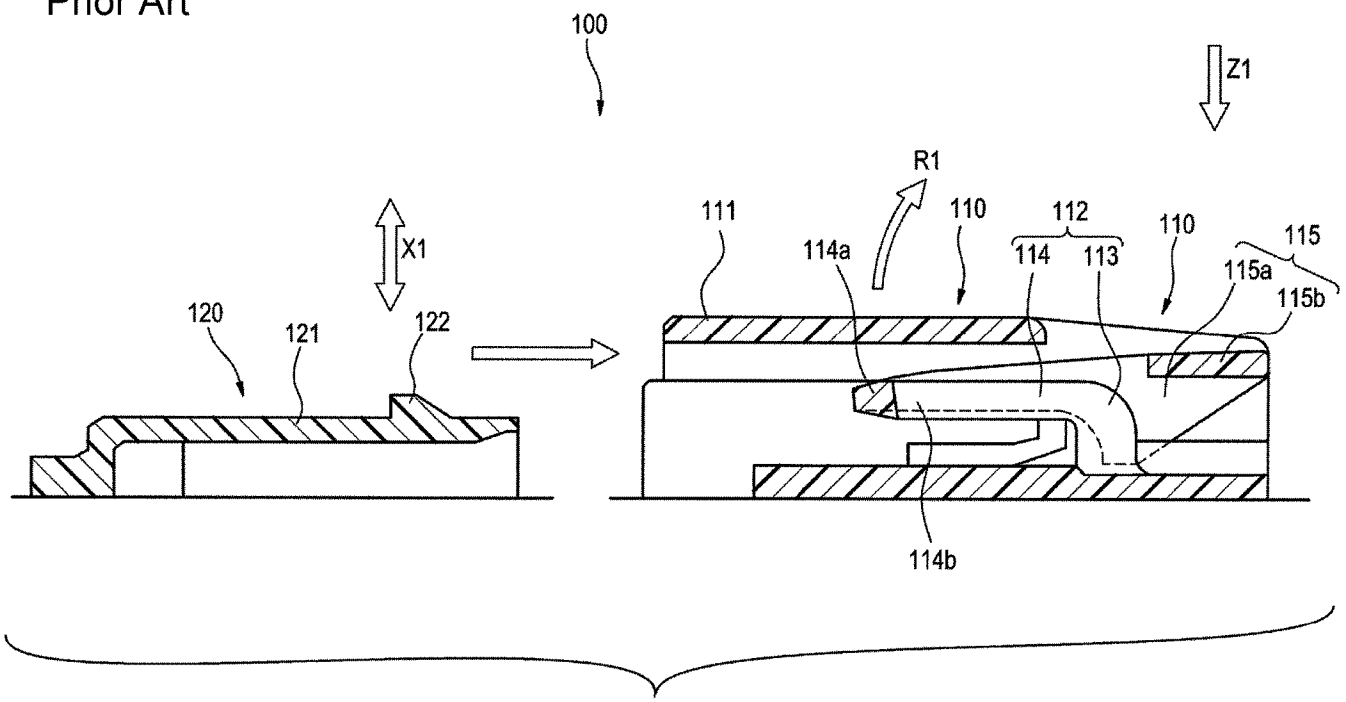
FIG. 6 Prior Art
FIG. 6 is a longitudinal sectional view of a main part of a connector according to the background art.
Figure 7:
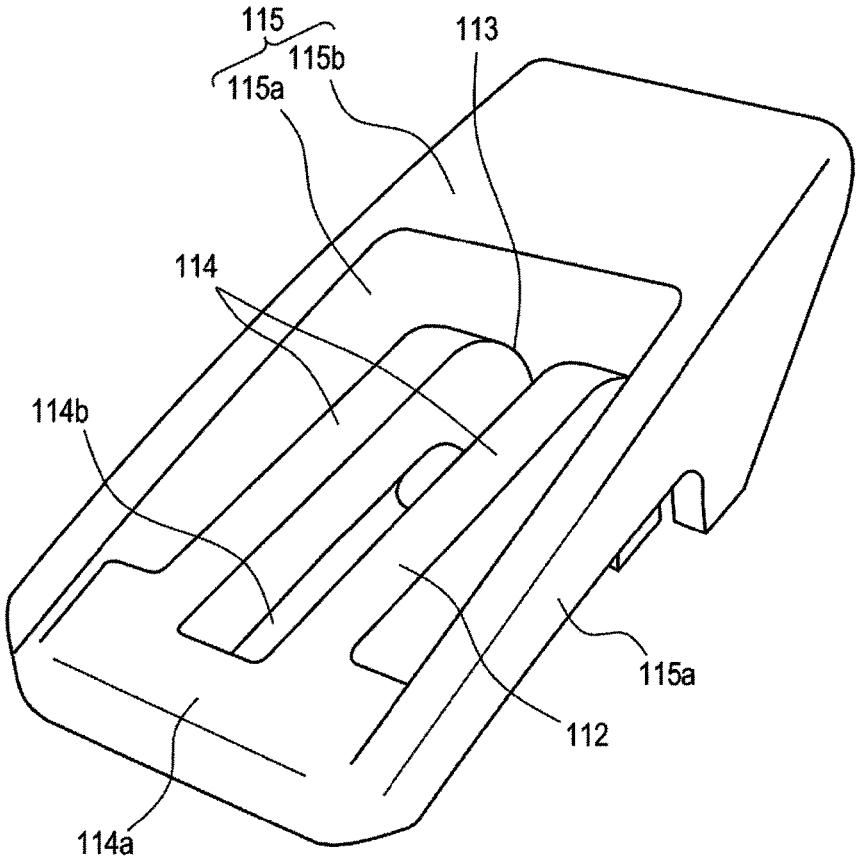
FIG. 7 Prior Art
FIG. 7 is an enlarged perspective view of a lock arm of a first connector housing shown in FIG. 6.
Figure 8:
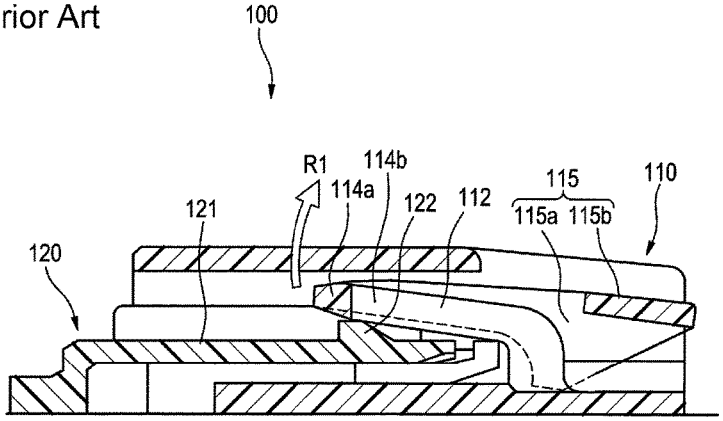
FIG. 8 Prior Art
FIG. 8 is a longitudinal sectional view showing a state in the middle of fitting between the first connector housing and a second connector housing shown in FIG. 6.
Figure 9:
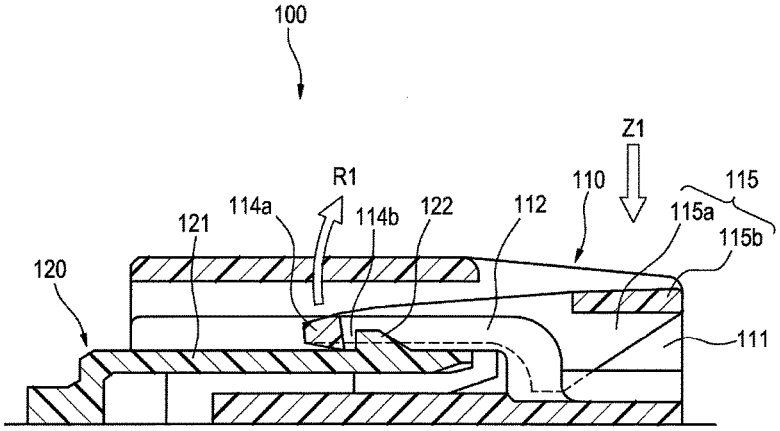
FIG. 9 Prior Art
FIG. 9 is a longitudinal sectional view showing a state in which the fitting between the first connector housing and the second connector housing shown in FIG. 6 is completed.

Assume that a fitting length between the cylindrical portion 82 of the second connector housing 8 and the terminal storing portion 51 reaches a predetermined value so that fitting between the first connector housing 5 and the second connector housing 8 is completed, as shown in FIG. 5. In this case, the lock arm 53 is engaged with a lock protrusion 83 on the second connector housing 8 to thereby lock the fitting state between the first connector housing 5 and the second connector housing 8.

The lock arm 53 according to the embodiment is formed integrally with the terminal storing portion 51 so that when the cylindrical portion 82 of the second connector housing 8 is fitted to an inner side of the hood portion 52, a free end side of the lock arm 53 can be deflected and deformed in a direction perpendicular to the surface of the cylindrical portion 82 of the second connector housing 8.

Figure 2:
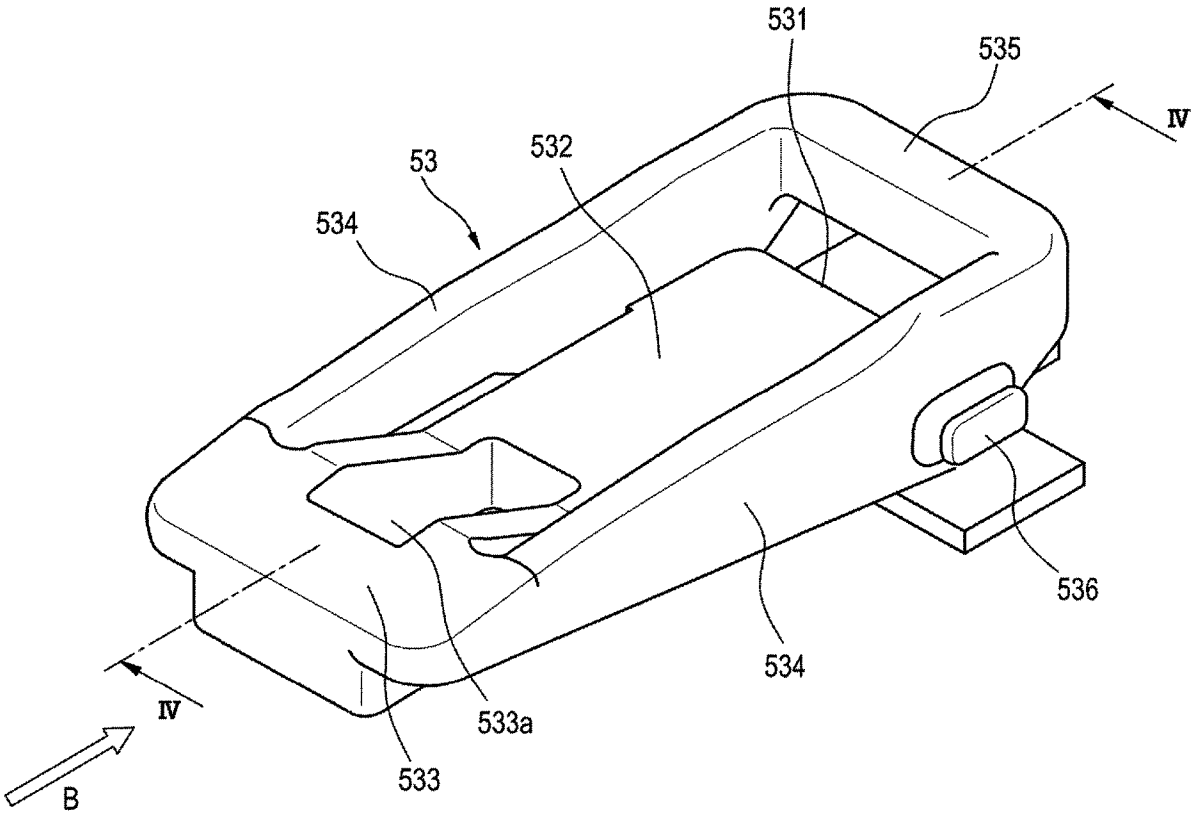
FIG. 2 is an enlarged perspective view of a lock arm in a first connector housing shown in FIG. 1.
Figure 3:
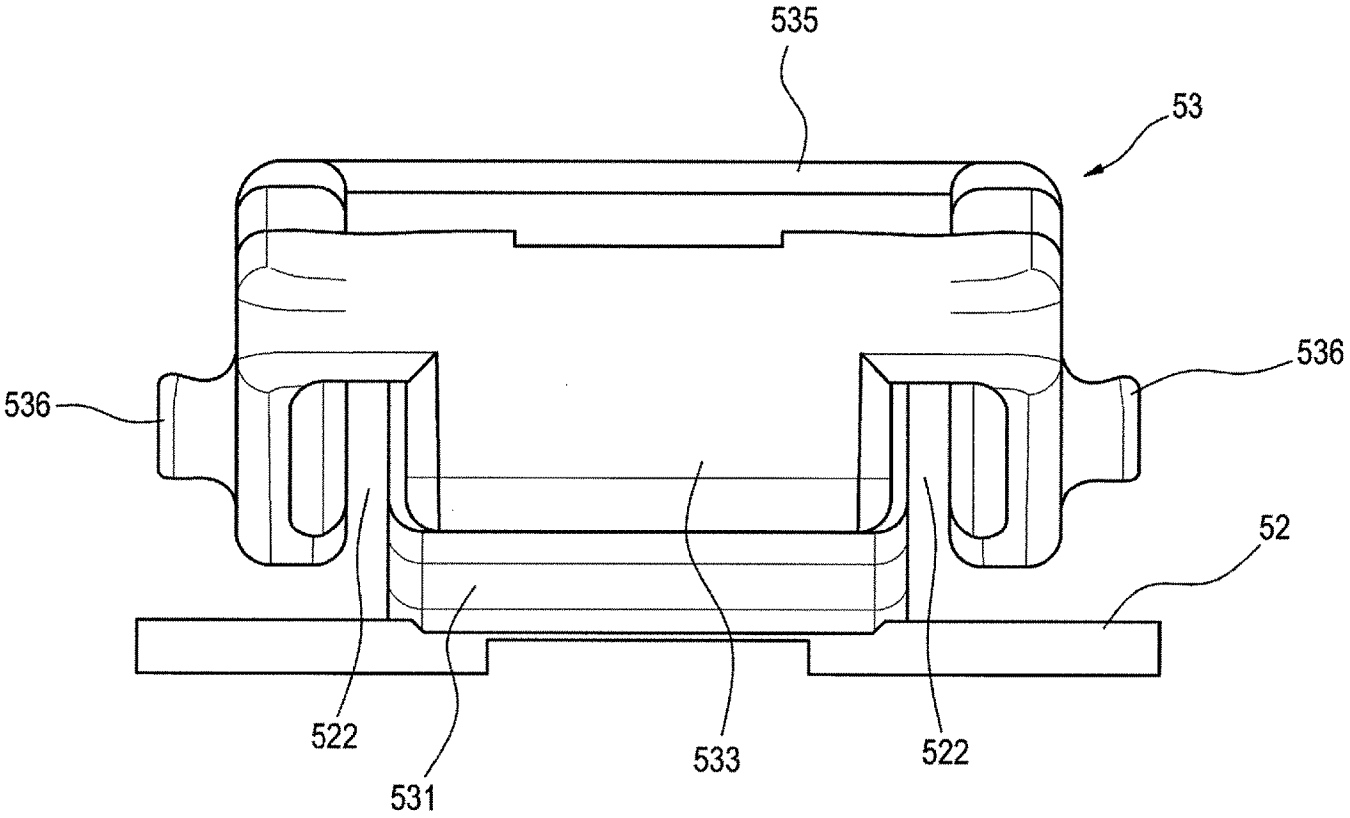
FIG. 3 is a view observed in the direction of an arrow B of FIG. 2.
Figure 4:
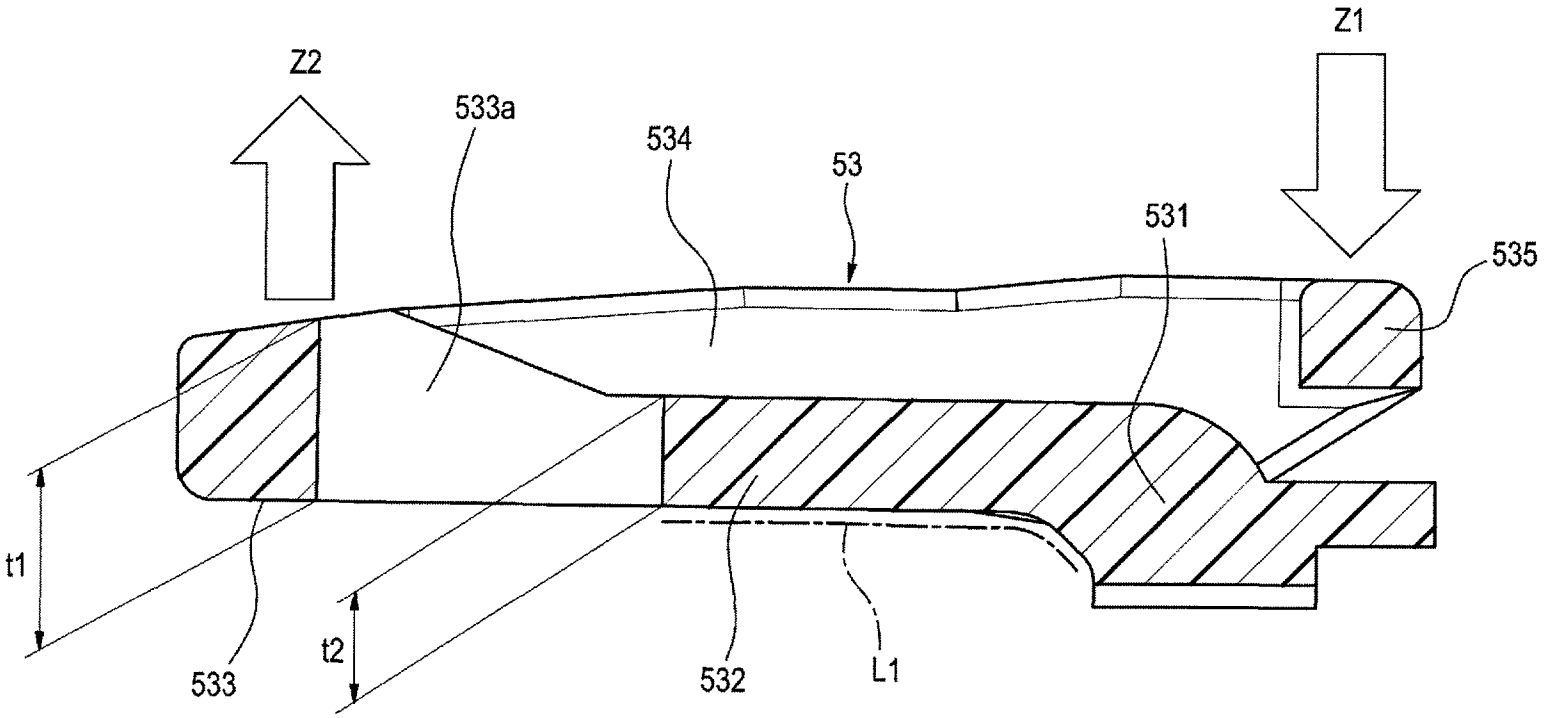
FIG. 4 is a sectional view of the lock arm shown in FIG. 2, taken along a line IV-IV.

Specifically, as shown in FIGS. 2 to 4, the lock arm 53 includes a base end portion 531, a plate spring portion 532, a protrusion engagement portion 533, a pair of coupling arm portions 534, an operating portion 535, and stoppers 536. The base end portion 531 rises from the terminal storing portion 51. The plate spring portion 532 is substantially shaped like a flat plate extending in the fitting direction X2 between the connector housings from a distal end (upper end) of the base end portion 531 toward a front end side (second connector housing 8 side) of the first connector housing 5. The protrusion engagement portion 533 is provided in a distal end of the plate spring portion 532 so that the lock protrusion 83 on the second connector housing 8 can be engaged with the protrusion engagement portion 533. The plate spring portion 532 is formed into a single-end supported beam shape with the distal end serving as a free end. The pair of coupling arm portions 534 extend from both sides of the protrusion engagement portion 533 toward a rear end side of the first connector housing 5. Rear end portions of the pair of coupling arm portions 534 are coupled to each other through the operating portion 535. The stoppers 536 are provided to protrude from side surfaces of the coupling arm portions 534. A gap is secured under the coupling arm portions 534.

As shown in FIG. 2 and FIG. 4, the protrusion engagement portion 533 has an engagement hole 533*a* with which the lock protrusion 83 on the second connector housing 8 is engaged.

In the case of the lock arm 53 according to the embodiment, the plate spring portion 532 is deflected and deformed in a direction of an arrow Z2 (see FIG. 4) perpendicular to the extension direction in the middle of fitting between the first connector housing 5 and the second connector housing 8. Thus, the lock protrusion 83 of the second connector housing 8 can slip under the protrusion engagement portion 533. When the fitting between the first connector housing 5 and the second connector housing 8 is completed, the position of the protrusion engagement portion 533 is returned to an initial position before the deflection and deformation, due to restoring force of the plate spring portion 532. Thus, as shown in FIG. 5, the lock protrusion 83 of the second connector housing 8 is engaged with the engagement hole 533*a* to thereby lock the connection between the first connector housing 5 and the second connector housing 8.

Assume that the coupling arm portions 534 swing due to pushing down of the operating portion 535 to thereby result in upward movement of the protrusion engagement portion 533 connected to front ends of the coupling arm portions 534 in the direction of the arrow Z2 (see FIG. 4). In this case, engagement between the protrusion engagement portion 533 and the lock protrusion 83 is released so that the first connector housing 5 and the second connector housing 8 can be disconnected from each other.

The stoppers 536 (see FIGS. 2 and 3) on the coupling arm portions 534 can abut against not-shown interference portions of the first connector housing 5. The stoppers 536 are regions which prevent the coupling arm portions 534 from being displaced excessively to be damaged when force in an opposite direction to the direction of the arrow Z1 is applied to the side of the operating portion 535.

In the lock arm 53 according to the embodiment, the base end portion 531 rising from the terminal storing portion 51 is formed into a smooth curved shape with which a bending load is difficult to be concentrated. Therefore, when the plate spring portion 532 is deflected and deformed in the middle of fitting between the connector housings or during pushing down of the operating portion 535, shear stress is not concentrated on the base end portion 531 but can be dispersed in a wide range on the plate spring portion 532. A region L1 on the plate spring portion 532 designated by a one-dot chain line in FIG. 4 expresses a region where shear stress is dispersed and acts when the plate spring portion 532 is deflected and deformed.

In addition, in the case of the embodiment, as shown in FIG. 4, a thickness t1 of the protrusion engagement portion 533 of the lock arm 53 is set to be larger than a thickness t2 of the plate spring portion 532. That is, the protrusion engagement portion 533 is formed to be thicker than the plate spring portion 532.

The packing 6 is shaped like a cylinder outer-fitted to the terminal storing portion 51 of the first connector housing 5. The packing 6 is integrally molded of synthetic rubber or natural rubber having moderate elasticity.

As shown in FIG. 5, an inner circumferential surface 61 of the packing 6 is a smooth surface which makes tight contact with an outer circumferential surface of the terminal storing portion 51. In addition, two annular protrusions (rib portions) 621 are provided in an outer circumferential surface 62 of the packing 6 so that the two annular protrusions 621 can make tight contact with an inner circumference of the cylindrical portion 82 of the second connector housing 8. As shown in FIG. 5, the inner circumferential surface 61 of the packing 6 is in tight contact with the outer circumferential surface of the terminal storing portion 51 and the annular protrusions 621 of the outer circumferential surface 62 are in tight contact with the inner circumferential surface of the cylindrical portion 82. Thus, waterproofness inside the housing can be secured.

The second connector housing 8 is a housing fixedly provided in a housing 9 of an apparatus etc. In addition, the second connector housing 8 is an integrally molded article made of PBT (polybutylene terephthalate resin) whose strength is improved by adding glass fiber to the resin. As shown in FIG. 1, the second connector housing 8 includes a terminal array space 81, the cylindrical portion 82, the lock protrusion 83, the horizontal guide ribs 84 and the vertical guide ribs 85. Distal end portions of second terminal metal fittings protrude in the terminal array space 81.

Incidentally, the second connector housing 8 has no region which has to be deflected and deformed like the lock arm 53 of the first connector housing 5. Accordingly, a material lower in strength than that of the first connector housing 5 may be used.

The terminal array space 81 is a space in which the distal end portions of the second terminal metal fittings (not shown) protrude so that the second terminal metal fittings can be fitted to the first terminal metal fittings inside the terminal storing portion 51.

The cylindrical portion 82 is shaped like a cylinder surrounding the terminal array space 81 so as to define the terminal array space 81. The cylindrical portion 82 is inserted into the gap 54 of the first connector housing 5 to be fitted to the outer circumference of the terminal storing portion 51. On this occasion, the cylindrical portion 82 is fitted to the inner circumference of the hood portion 52. As shown in FIG. 5, the annular protrusions 621 of the packing 6 are in tight contact with the inner circumferential surface of the cylindrical portion 82 outer-fitted to the terminal storing portion 51. Thus, the gap between the cylindrical portion 82 and the terminal storing portion 51 is sealed.

The lock protrusion 83 is a protrusion provided to protrude from the outer surface of the cylindrical portion 82. When the fitting length between the cylindrical portion 82 and the terminal storing portion 51 reaches the predetermined value, the lock protrusion 83 is engaged with the lock arm 53 to thereby lock the connection state between the first connector housing 5 and the second connector housing 8, as shown in FIG. 5.

When the first connector housing 5 and the second connector housing 8 are fitted to each other, the horizontal guide ribs 84 are engaged with the horizontal guide grooves 521 of the first connector housing 5 slidably. Thus, occurrence of inclination between the housings is prevented.

When the first connector housing 5 and the second connector housing 8 are fitted to each other, the vertical guide ribs 85 are engaged with the vertical guide grooves 522 of the first connector housing 5 slidably. Thus, occurrence of inclination between the housings is prevented.

That is, in the first connector housing 5 and the second connector housing 8 according to the embodiment, the horizontal guide ribs 84 and the vertical guide ribs 85 of the second connector housing 8 are engaged with the horizontal guide grooves 521 and the vertical guide grooves 522 provided in the first connector housing 5. In this manner, a direction of moving the connector housings relatively to each other is restricted to thereby prevent occurrence of inclination from the fitting direction.

In the case of the configuration of the connector 4 according to the aforementioned embodiment, degradation of material properties can hardly occur even when the first connector housing 5 which is formed of a hydrolysis-resistant material is used for a long term under a high temperature high humid environment such as an engine room. Therefore, even when connection/disconnection between the connector housings is repeated, the lock arm 53 undergoing a bending load can be suppressed from being damaged due to the degradation of the material. Accordingly, the lock arm 53 can be used satisfactorily for a long term.

In addition, in the case of the configuration of the connector 4 according to the embodiment, the base end portion 531 of the lock arm 53 rising from the terminal storing portion 51 is formed into a smooth curved shape with which a bending load is difficult to be concentrated. Therefore, when the lock arm 53 is deflected and deformed in order to be engaged with or disengaged from the lock protrusion 83 of the second connector housing 8, the bending load can be prevented from concentratively acting on a part of the base end portion 531 of the lock arm 53. Thus, durability of the lock arm 53 can be improved.

In addition, in the case of the configuration of the connector 4 according to the embodiment, the engagement hole 533*a* with which the lock protrusion 83 is engaged is formed in the protrusion engagement portion 533 of the lock arm 53. The formation of the engagement hole 533*a* is unfavorable for the strength of the protrusion engagement portion 533. However, the protrusion engagement portion 533 is formed to be thicker than the plate spring portion 532 so that the strength of the protrusion engagement portion 533 can be improved. Accordingly, the strength of the protrusion engagement portion 533 of the lock arm 53 can be prevented from being lower than that of the plate spring portion 532 so that durability of the lock arm 53 can be improved.

In addition, in the case of the configuration of the connector 4 according to the embodiment, the gap is secured under the coupling arm portions 534. Accordingly, even when some force is applied to the operating portion 535, the protrusion engagement portion 533 is not lifted up so that unprepared disengagement between the engagement hole 533*a* and the lock protrusion 83 can be prevented.

Incidentally, the invention is not limited to the aforementioned embodiment. However, modification, improvement, etc. may be made on the invention suitably. In addition thereto, the material, shape, dimensions, number, arrangement place, etc. of each constituent member in the aforementioned embodiment are not limited but may be set desirably as long as the invention can be achieved.

For example, the material of the first connector housing having the lock arm is not limited to PBT-GF15. Another resin material having hydrolysis resistance may be used. In addition, the retainer or the second connector housing may be formed of the same resin material as that of the first connector housing.

Incidentally, a resin material with enhanced hydrolysis resistance is more expensive than an ordinary resin material with inferior hydrolysis resistance. Accordingly, the second connector housing having no region which has to be deflected and deformed when the connector housings are connected to or disconnected from each other is formed of a resin material more inexpensive than that of the first connector housing. Thus, reduction of cost can be achieved.

Here, the aforementioned characteristics of the embodiment of the connector according to the invention will be summarized and listed briefly in the following items [1] to [3] respectively.

[1] A connector (4) including: a first connector housing (5) including a hood portion (52) having a substantially cylinder shape to be fitted to an outer circumference of a cylindrical portion (82) of a connection counterpart connector housing (a second connector housing 8), a terminal storing portion (51) which stores a terminal metal fitting, and a lock arm (53) formed integrally with the terminal storing portion (51) such that a free end side of the lock arm (53) is deflected and deformed in a direction perpendicular to a surface of the cylindrical portion (82); and a second connector housing (8) including the cylindrical portion (82), and a lock protrusion (83) which is provided to protrude from an outer surface of the cylindrical portion (82) and which engages the lock arm (53) when a fitting length between the cylindrical portion (82) and the terminal storing portion (51) reaches a predetermined value, wherein the first connector housing (5) is formed of a hydrolysis-resistant material.

[2] The connector (4) according to the aforementioned item [1], wherein a base end portion (531) of the lock arm (53) rising from the terminal storing portion (51) is formed into a smooth curved shape with which a bending load is difficult to be concentrated.

[3] The connector (4) according to the aforementioned item [2], wherein the lock arm (53) includes a plate spring portion (532) having a flat plate shape extending in a fitting direction (X2) between the connector housings from a distal end of the base end portion (531), and a protrusion engagement portion (533) which has an engagement hole (533*a*) with which the lock protrusion (83) is engaged and which is provided in a distal end of the plate spring portion (532), and wherein the protrusion engagement portion (533) is formed to be thicker than the plate spring portion (532).

The present application is based on a Japanese patent application (Patent Application No. 2014-072817) filed on Mar. 31, 2014, the contents of which are incorporated herein by reference.

INDUSTRIAL APPLICABILITY

In the connector according to the invention, the lock arm undergoing a bending load acts when the connector housings are connected to or disconnected from each other can be suppressed from being damaged due to degradation of the material even in long-term use under a high temperature high humid environment. Thus, the lock arm can be used satisfactorily for a long term.

DESCRIPTION OF REFERENCE SIGNS

4: Connector
5: First Connector Housing
6: Packing
7: Retainer
8: Second Connector Housing (Connection Counterpart Connector Housing)
51: Terminal Storing Portion
52: Hood Portion
53: Lock Arm
54: Gap
71: Housing Lock Arm
81: Terminal Array Space
82: Cylindrical Portion
83: Lock Protrusion
524: Retainer Inserting Port
531: Base End Portion
532: Plate Spring Portion
533: Protrusion Engagement Portion
533*a*: Engagement Hole

The invention claimed is:

1. A connector comprising:

a first connector housing comprising:

a hood portion having a substantially cylinder shape to be fitted to an outer circumference of a cylindrical portion of a connection counterpart connector housing;

a terminal storing portion which stores a terminal metal fitting; and a lock arm formed integrally with the terminal storing portion such that a first free end of the lock arm is deflected and deformed in a first direction perpendicular to a surface of the cylindrical portion, the lock arm comprising:

a coupling arm portion;

a protrusion engagement portion located at the first free end;

a base end portion rising from the terminal storing portion that is formed into a smooth curved shape with which a bending load is difficult to be concentrated, the smooth curved shape includes a convex curved surface and a concave curved surface, the convex curved surface faces away from the terminal storing portion and extends from the terminal storing portion toward the protrusion engagement portion, and the concave curved surface faces toward the terminal storing portion and extends from the terminal storing portion toward the protrusion engagement portion, wherein the convex curved surface of the base end portion rises from the terminal storing portion at a different position in the first direction than the concave curved surface of the base end portion;

an operation portion connected to the first free end via the coupling arm portion and defining a second free end that is cantilevered to the first free end; and a stopper which is provided on the coupling arm portion and prevents the coupling arm portion from being displaced excessively to be damaged when force in the first direction is applied to the operation portion; and a second connector housing comprising:

the cylindrical portion; and a lock protrusion which is provided to protrude from an outer surface of the cylindrical portion and which engages protrusion engagement portion of the lock arm when a fitting length between the cylindrical portion and the terminal storing portion reaches a predetermined value, wherein the first connector housing is formed of a hydrolysis-resistant material.

2. The connector according to claim 1, wherein the lock arm comprises a plate spring portion having a flat plate shape extending in a fitting direction between the connector housings from a distal end of the base end portion, the protrusion engagement portion has an engagement hole with which the lock protrusion is engaged, and the protrusion engagement portion is formed to be thicker than the plate spring portion.

3. The connector according to claim 1, wherein the position on the terminal storing portion from which the convex curved surface rises is spaced further in the first direction than that from which the concave curved surface rises.

4. The connector according to claim 3, wherein an entirety of the convex curved surface is disposed farther from the terminal storing portion than an entirety the concave curved surface.

* * * * *